US007264439B2

(12) United States Patent
Adamietz et al.

(10) Patent No.: US 7,264,439 B2
(45) Date of Patent: Sep. 4, 2007

(54) EVACUATING DEVICE

(75) Inventors: Ralf Adamietz, Wermelskirchen (DE); Roland Blumenthal, Cham (CH); Dirk Kalisch, Köln (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 175 days.

(21) Appl. No.: 10/517,113

(22) PCT Filed: May 16, 2003

(86) PCT No.: PCT/EP03/05136

§ 371 (c)(1),
(2), (4) Date: Dec. 3, 2004

(87) PCT Pub. No.: WO2004/015272

PCT Pub. Date: Feb. 19, 2004

(65) Prior Publication Data

US 2005/0220607 A1 Oct. 6, 2005

(30) Foreign Application Priority Data

Jun. 4, 2002 (DE) ..... 102 24 604

(51) Int. Cl.
*F01D 5/00* (2006.01)
*F01D 1/36* (2006.01)

(52) U.S. Cl. ..... 415/55.2; 415/56.2; 415/73; 415/90

(58) Field of Classification Search ..... 415/55.1, 415/56.2, 55.3, 55.2, 73, 72, 90
See application file for complete search history.

(56) References Cited

U.S. PATENT DOCUMENTS

| | | | | |
|---|---|---|---|---|
| 2,730,297 | A | 1/1956 | Van Dorsten et al. | 230/118 |
| 3,697,190 | A * | 10/1972 | Haentjens | 415/73 |
| 4,826,394 | A | 5/1989 | Lotz | 415/72 |
| 4,893,985 | A | 1/1990 | Hölss | 415/90 |
| 4,978,276 | A | 12/1990 | Kabelitz et al. | 415/55.3 |
| 5,011,368 | A | 4/1991 | Frindel et al. | 415/90 |
| 5,020,969 | A | 6/1991 | Mase et al. | 415/55.3 |
| 5,632,597 | A | 5/1997 | Hiroki et al. | 415/90 |

(Continued)

FOREIGN PATENT DOCUMENTS

DE 36 133 44 A 10/1987

(Continued)

*Primary Examiner*—Edward K. Look
*Assistant Examiner*—Dwayne J White
(74) *Attorney, Agent, or Firm*—Fay Sharpe LLP

(57) ABSTRACT

A device (1), for evacuating a chamber to pressures in the high vacuum range includes a suction-side vacuum pump (2) and an atmospheric-pressure-side vacuum pump (3). The suction-side vacuum pump (2) is a mechanical kinetic vacuum pump with a rotor (11) and a stator (10). The stator (10) has a rotationally-symmetrical inner surface which matches the outer rotor geometry. The rotor (11) in the mechanical kinetic vacuum pump (2) is provided with a structure (13) carrying out the gas pumping. Said gas pumping structure comprises webs (14), the angle and width of which decrease from the suction side to the pressure side. The gas throughflow is improved. The outer diameter of the rotor (11) and the inner diameter of the stator (10) of the suctnion-side pump decrease from the suction side to the pressure side.

5 Claims, 2 Drawing Sheets

U.S. PATENT DOCUMENTS 6,419,444 B1 * 7/2002 Kabasawa et al. ..... 415/72
6,514,035 B2 * 2/2003 Iwane et al. ..... 415/72

FOREIGN PATENT DOCUMENTS

DE 37 28 154 A 3/1989
DE 37 91 053 T 12/1989
DE 39 32 228 A1 4/1990
DE 69 003 256 T 1/1994
DE 196 09 308 A1 10/1996
EP 0 363 503 A1 4/1990
JP 63-154891 6/1988

* cited by examiner

Fig.1
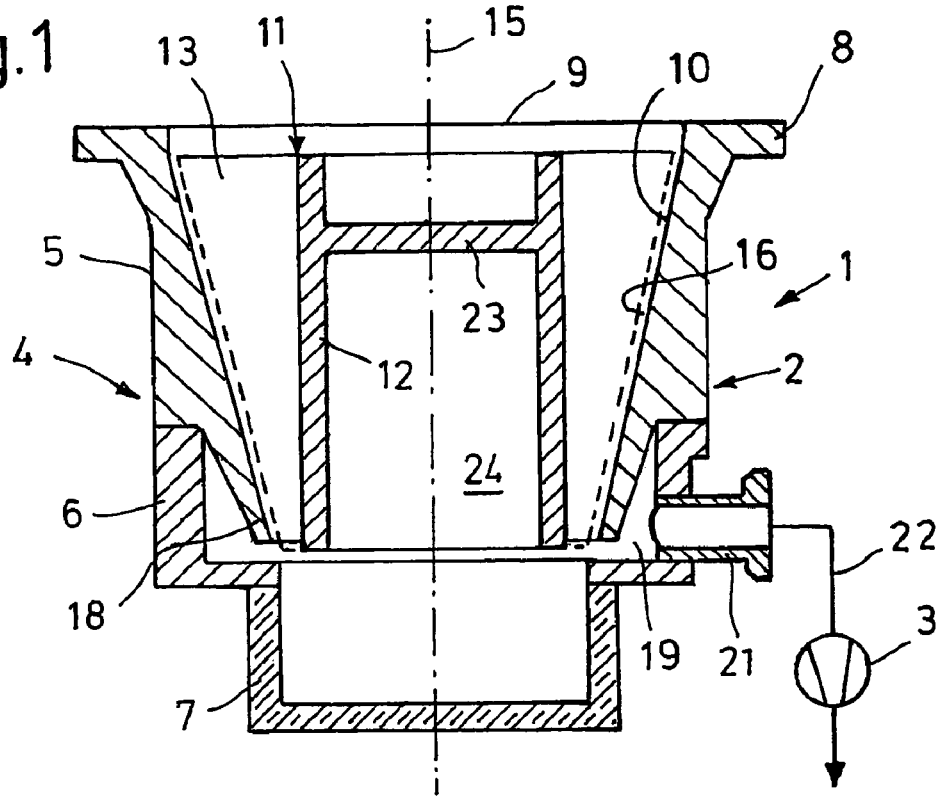
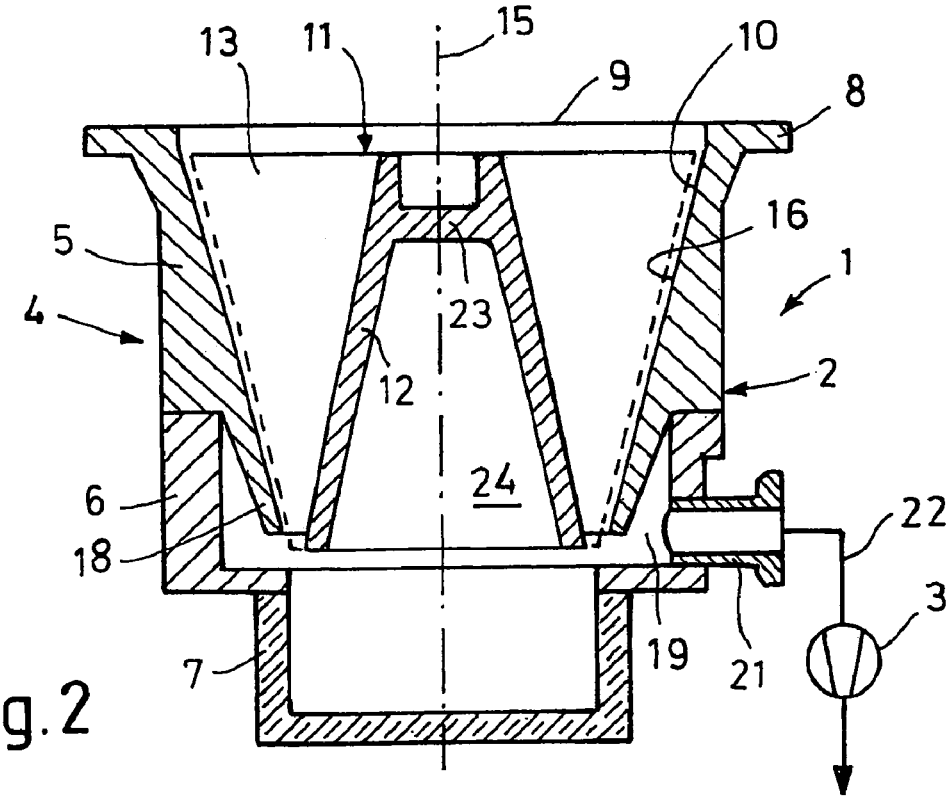
Fig.2

Fig.3
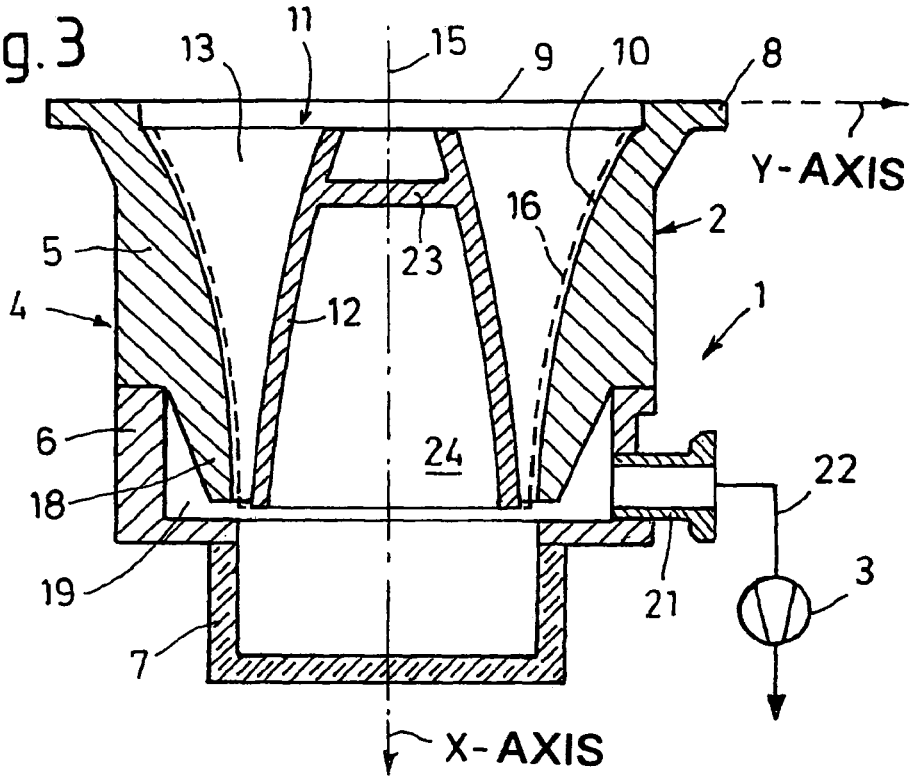
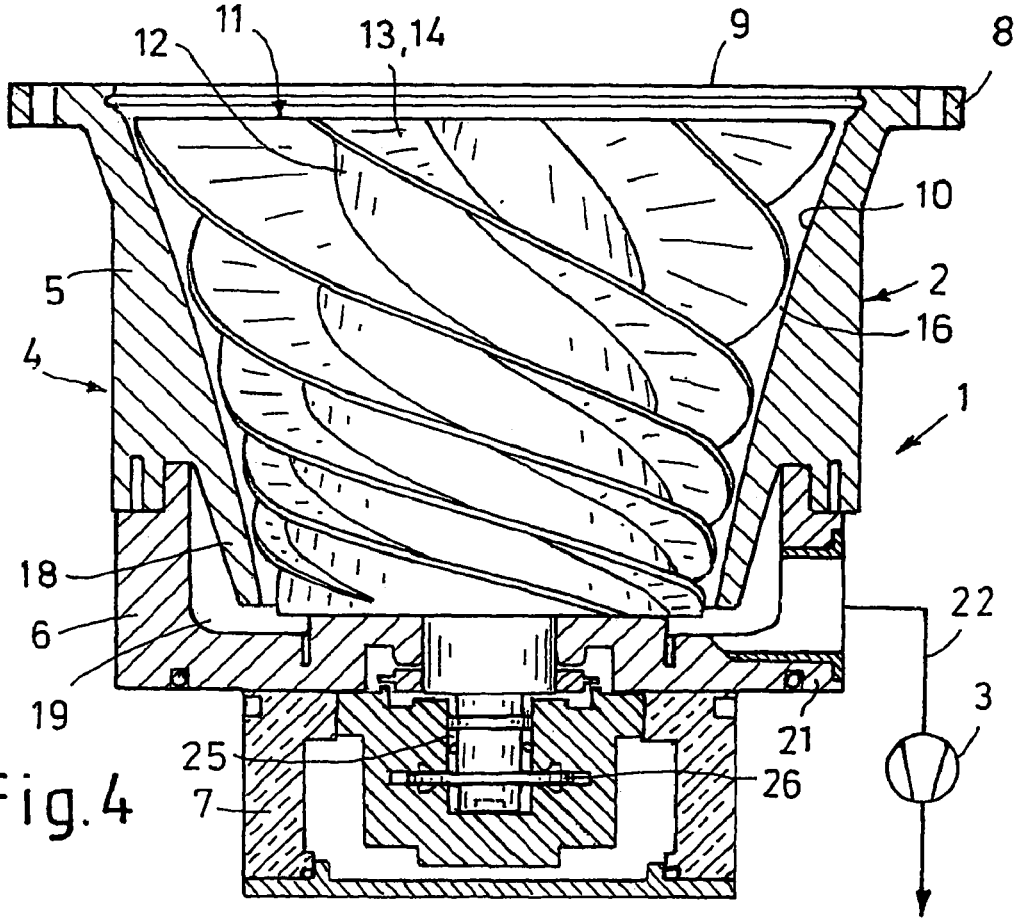
Fig.4

EVACUATING DEVICE

BACKGROUND

The invention relates to evacuation devices.

If in a process chamber, or in any other vacuum chamber, pressures are supposed to be generated which lie in the high vacuum range ($<=10^{-3}$ mbar), it is customary to use evacuation devices with a suction-side vacuum pump and an atmospheric pressure-side vacuum pump (backing vacuum pump). The suction-side vacuum pump is, as a rule, a mechanical, kinetic vacuum pump. Among these are gas ring vacuum pumps and turbo vacuum pumps (axial, radial) as well as molecular and turbomolecular vacuum pumps.

At pressures of said type the gases to be conveyed behave molecularly, that is, in such a way that a directed flow can only be achieved by pump structures which give the individual gas molecules pulses with a preferred direction, the desired direction. Since the gas molecules in the chamber to be evacuated have no preferred direction, only those gas molecules get into the suction nozzles of the connected vacuum pump which randomly have this direction of motion.

From U.S. Pat. No. 4,978,276, an evacuation device of the type relevant here is known. The rotor and stator of the mechanical-kinetic vacuum pump are formed to be cylindrical. In order to achieve the result that as many gas molecules as possible go into the suction nozzles of the vacuum pump connected to the chamber, i.e. the suction-side vacuum pump, the rotor has a conical hub whose diameter increases in the direction of the pressure side. The width of the webs between the hub and the cylindrical inner face of the stator decreases accordingly in the direction of the pressure side. This realization has the advantage that the inlet cross-section for the gases behaving molecularly, i.e. the suction-side annular surface in which the gases to be conveyed enter, is relatively large. An evacuation device of the known type is thus particularly suitable for those applications in which there is a demand for high gas throughputs.

The objective of the present invention is to further improve an evacuation device of the type relevant here with respect to the demand for high gas through puts.

SUMMARY

At the suction-side annular surface, gases behaving molecularly enter in the radial direction. An enlargement of the inlet cross-section is achieved, even in the case of a cylindrical structure of the rotor hub, since the inlet cross-section increases quadratically with the radius. Furthermore, the radially outermost edges of the rotor's components (webs) effecting the gas conveyance have, as a consequence, higher circumferential speeds, whereby the gas throughput is further increased.

It is particularly advantageous if the hub is structured conically. In the case of an evacuation device formed in this way the inlet cross-section is greater.

Finally, it is advantageous if the lines, which represent the form of the outer diameter of the rotor as well as the inner diameter of the stator in a longitudinal section through the suction-side vacuum pump, run in the form of a curve arched inwards in such a manner that the slope of the curves increases from the suction side to the pressure side. It is particularly expedient if these lines have essentially the form of a hyperbola. This structure of the suction-side vacuum pump ensures an optimal and, above all, disruption-free flow of the conveyed gases and thus contributes to the improvement of the gas throughput. In all, an improvement of the capacity density is achieved, that is, that the ratio of the capacity of the suction-side vacuum pump to its mass is greater than in the state of the art.

Still further advantages of the present invention will be appreciated to those of ordinary skill in the art upon reading and understand the following detailed description.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

FIG. 1 is a section through an embodiment with a conical stator and a cylindrical rotor hub, FIG. 2 is a section through an embodiment with a conical stator and a conical rotor hub, FIG. 3 is a section through an embodiment with a stator arched inwards and a rotor hub arched outwards, FIG. 4 illustrates an embodiment according to FIG. 3 in which the rotor is represented in a perspective view.

DETAILED DESCRIPTION

In the Figures, the device is denoted by 1. The suction-side vacuum pump is denoted by 2. The atmospheric pressure-side vacuum pump, only represented symbolically, is denoted by 3. The suction-side pump 2 is a mechanical-kinetic vacuum pump. It comprises a three-part housing 4 with sections 5, 6, and 7. The suction-side section 5 is provided with a flange 8 which forms a suction aperture 9 and serves for the connection to a system to be evacuated. Its inner wall 10 forms the stator component of the mechanical-kinetic vacuum pump 2. The housing section 5 encircles a rotor 11. This comprises a hub 12, which carries on its outer side the structure 13 which effects the gas conveyance. This structure consists of webs 14 (in particular, FIG. 4) whose pitch and width decrease from the suction side to the pressure side. The axis of rotation of the rotor 11 is denoted by 15. Between the outer contour of the rotor 11 and the stator, i.e. the inner wall 10 of the housing 4, there is a gap 16, which should be as small as possible to avoid significant back-flows.

The housing section 5, structured, at least on its inner side, conically, is supported on the central, essentially cylindrical housing section 6. A lower end section 18 of the lower part of the housing section 5 projects into the housing section 6, and, in fact, up to the pressure-side end of the rotor 11. The gases conveyed by the rotor 11 and by the stator 10 arrive in an annular chamber 19, to which an outlet nozzle 21 is attached. This is connected to the atmospheric pressure-side vacuum pump 3 via line 22.

The hub 12 is hollow. In the area of the suction side it includes a disk 23 which separates a pressure-side cavity 24 in the hub 12 from the suction side.

The lower housing section 7 is formed to be somewhat vat-shaped and is fastened to the central housing section 6. Together with the pressure-side cavity 24 in the hub 12, it forms a motor and bearing area. In FIGS. 1 to 3 a drive motor and bearings for the rotor are not represented in detail. These components are known per se. The bearings preferably are magnetic bearings. They are particularly suitable for mechanical-kinetic vacuum pumps due to their high rotary speeds. Those parts of the drive and bearing system which project into the housing section 7 are represented in FIG. 4.

A brake 25 for cases of lubrication failure and components 26 of a brake for cases of instability can be seen.

In the embodiments according to FIGS. 1 and 2, the outer contour of the rotor 11 and the stator 10 inner surface of the housing 2 are formed to be conical and, in fact, in such a manner that the diameters of the outer contour of the rotor and of the stator decrease from the suction side to the pressure side. Thereby the desired increase of the inlet cross-section for the molecules to be removed from the connected vacuum chamber as well as the circumferential speed of the structure 13 is achieved. In the embodiment according to FIG. 2 the hub 12 of the rotor 11 is also formed to be conical, and, in fact, in such a manner that the hub diameter increases from the suction side to the pressure side. The inlet surface for the molecules to be conveyed is enlarged by this measure.

In the embodiments according to FIGS. 3 and 4, the outer contour of the rotor 11 and the stator 10 have an arching directed inwards. Experiments and calculations have yielded the result that, due to this measure, improved, i.e., disruption-free, gas flow through the pump 2 can be achieved.

It is particularly expedient if the stator 10 and the outer contour of the rotor 11 have a hyperbolic curve. The result of this measure is the following calculation:

Following a greatly simplified approach to the description of the mode of function of a threaded pump, one can, ignoring slip effects and gap back-flow, write the following equation:

$$q = \frac{zhUa\cos\alpha}{2\left(1+\frac{s}{h}\right)}p - \frac{zh^3ap}{12\eta}\frac{dp}{dx}$$

with z number of channels h thread depth

U circumferential speed a channel width

α thread pitch s gap between the upper edge of the thread web and the stator p averaged pressure in a small area dx of the thread η dyn. viscosity q gas flow The first term describes the Cuette flow while the second term describes the channel back-flow arising due to the pressure gradient. All the geometry data, with the exception of the channel depth, can be assumed as essentially constant over the axial length. Furthermore, the denominator in the first term is approximated by 2 since the ratio s/h is rather small. Also, the viscosity is approximated as a quantity independent of pressure.

One can thus write:

$$q = Ahp - Bph^3\frac{dp}{dx} \text{ or } \frac{dp}{dx} = \frac{A}{Bh^2} - \frac{q}{Bph^3}$$

This means there is, for a predefined pressure p and gas flow q, a certain channel depth h at which the pressure gradient is maximal. This optimal channel depth can be found by the differentiation of dp/dx by h:

$$\frac{d}{dh}\left(\frac{dp}{dx}\right) = 0 = -\frac{2A}{3h^3} + \frac{3q}{Bph^4}$$

or also $$h_{opt}(x)=9q/2ABp(x)$$

In the case of a linear pressure curve in the pump, in a coordinate system with the axis of rotation 15 as χ-axis, a hyperbolic curve for channel depth over the axial length of the rotor thus results, and, in fact, in such a manner that the slope of the hyperbola decreases from the suction side to the pressure side. The position of the χ-axis and the γ-axis are indicated in FIG. 3. This behavior is also confirmed by simulation by means of CFD software, which shows a weaker pump capacity of the rotor when its outer contour is conical or even cylindrical. Since, with an optimal rotor design, the mass, and thus the use of frictional surfaces, is automatically minimized, it is possible to drive, in direct comparison, higher gas throughputs.

In this calculation the form of the rotor hub 12 was initially not taken into account. It can be formed to be cylindrical, conical, or arched outwards, as represented in FIGS. 1 to 4. From the point of view of simple manufacture, the conical form (FIG. 2) is to be preferred. From the point of view of a possible disruption-free flow, a slight arching inwards, expediently also hyperbolic, is expedient.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A device for the evacuation of a chamber to pressures in the high vacuum range, comprising:

an atmospheric pressure side vacuum pump;

a mechanical-kinetic vacuum pump with a rotor and a stator, the stator having a rotationally symmetric inner surface, which conforms to an outer geometry of the rotor, the rotor of the mechanical-kinetic vacuum pump having a structure for effecting gas conveyance from a suction side to a pressure side connected to the pressure side vacuum pump;

the structure for effecting the gas conveyance includes webs whose pitch and width decrease from the suction side to the pressure side, an outer diameter of the rotor and an inner diameter of the stator of the mechanical-kinetic vacuum pump decrease from the suction side to the pressure side, the rotor including a hub, said hub carrying the webs and being formed conically in such a manner that its diameter increases from the suction side to the pressure side.

2. A device for the evacuation of a chamber to pressures in the high vacuum range, comprising:

a mechanical-kinetic vacuum pump with a rotor and a stator, the stator having a rotationally symmetric inner surface, which conforms to an outer geometry of the rotor, the rotor of the mechanical-kinetic vacuum pump having a structure for effecting gas conveyance from a suction side to a pressure side connectable to a pressure side vacuum pump;

the structure for effecting the gas conveyance including webs whose pitch and width decrease from the suction side to the pressure side, an outer diameter of the rotor and an inner diameter of the stator of the mechanical-kinetic vacuum pump decrease from the suction side to the pressure side, the outer diameter of the rotor and the inner diameter of the stator in a longitudinal section through the suction-side vacuum pump form a curve which arches inwards in such a manner that a slope of the curve decreases from the suction side to the pressure side.

3. The device according to claim 2, wherein the curve follows a hyperbola.

4. A mechanical-kinetic vacuum pump for the evacuation of a chamber to pressures in the high vacuum range, comprising:

a rotor and a stator, the stator having a rotationally symmetric inner surface, which conforms to an outer geometry of the rotor, the rotor having a hub with webs whose pitch and width decrease from the suction side to the pressure side for effecting gas conveyance from a suction side to a pressure side, a surface defined by the rotor hub in a longitudinal section trough the mechanical-kinetic vacuum pump arching outwards in such a manner that the slope of the surface decreases from the suction side to the pressure side, an outer diameter of the rotor and an inner diameter of the stator of the suction-side vacuum pump decrease from the suction side to the pressure side.

5. A mechanical-kinetic vacuum pump for evacuating a chamber connected at a suction side to a pressure less than $10^{-3}$ mbar, the mechanical kinetic vacuum pump comprising:

a rotor including a central hub and webs extending outward from the hub in a helical pattern, an angle and width of which decreases from the suction side to a pressure side, an outer diameter of the hub increasing from the suction side to the pressure side;

a stator having a rotationally-symmetrical inner surface which matches an outer geometry of the rotor webs, the outer rotor geometry and the stator inner surface decreasing in diameter from the suction side to the rotor side.

* * * * *